US009488369B2

(12) United States Patent
Cohen et al.

(10) Patent No.: US 9,488,369 B2
(45) Date of Patent: Nov. 8, 2016

(54) ENHANCED FLUE GAS DAMPER MIXING DEVICE

(75) Inventors: Mitchell B. Cohen, West Hartford, CT (US); Todd D. Hellewell, Windsor, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 550 days.

(21) Appl. No.: 13/464,963

(22) Filed: May 5, 2012

(65) Prior Publication Data

US 2013/0291983 A1 Nov. 7, 2013

(51) Int. Cl.
*B01F 5/04* (2006.01)
*F22B 37/40* (2006.01)

(52) U.S. Cl.
CPC ..... *F22B 37/40* (2013.01); *Y10T 137/87652* (2015.04)

(58) Field of Classification Search
CPC ..... G05D 23/13; G05D 23/132; G05D 23/1333; G05D 23/1393; F23N 1/00; F23N 3/00; F23N 5/00
USPC ..... 137/601.08, 601.09, 601.11; 236/12.13, 236/13.1, 12.15, 14, 15 R
See application file for complete search history.

(56) References Cited

U.S. PATENT DOCUMENTS 1,075,197 A * 10/1913 Hodge ..... F24F 3/14 236/13
2,891,576 A * 6/1959 Kennedy ..... F24F 3/0522 137/601.04
2,984,984 A * 5/1961 Dickey ..... 60/647
3,426,507 A * 2/1969 Kossowski ..... B03C 3/74 137/601.11
3,614,074 A * 10/1971 Wellford, Jr. ..... 432/48

(Continued)

FOREIGN PATENT DOCUMENTS

JP 60176345 A * 9/1985
JP 6446628 U 3/1989

(Continued)

OTHER PUBLICATIONS

Unofficial English Translation of Japanese Notice of Allowance issued in connection with corresponding JP Application No. 2013-097831 on Feb. 9, 2015.

*Primary Examiner* — Len Tran
*Assistant Examiner* — Kun Kai Ma
(74) *Attorney, Agent, or Firm* — GE Global Patent Operation; Stephen G. Midgley

(57) ABSTRACT

A gas mixing device has a plurality of interleaved rows of adjustable louvers. When at least two flowing gas streams are received that are desired to be mixed, the louvers of each row directs the gas streams in a direction different from that of the adjacent rows, mixing the gas streams. When effectively only a single flowing gas stream is received, the louvers are positioned vertically thereby reducing the pressure drop across the gas mixing device.

10 Claims, 2 Drawing Sheets

(56) References Cited

U.S. PATENT DOCUMENTS 3,771,559 A * 11/1973 Alley ..... F16K 1/165
137/601.06
3,901,275 A * 8/1975 Logsdon ..... F16K 11/052
137/599.03
3,973,590 A * 8/1976 Logsdon ..... F16K 11/16
137/599.03
4,109,704 A * 8/1978 Spethmann ..... 165/249
4,237,825 A * 12/1980 Kochey ..... F22B 35/00
122/347
4,241,647 A * 12/1980 Herr ..... F24F 13/1413
137/601.11
4,259,987 A * 4/1981 Janssen ..... 137/606
4,294,403 A * 10/1981 Ammons ..... F24F 3/048
165/256
5,538,539 A 7/1996 Spokoyny et al.
6,161,764 A * 12/2000 Jatnieks ..... 236/49.3
6,257,155 B1 * 7/2001 Greene ..... 110/163
2005/0022553 A1 * 2/2005 Abrams et al. ..... 62/617
2007/0218828 A1 * 9/2007 Baik ..... 454/256

FOREIGN PATENT DOCUMENTS

JP 181447 U 5/1989
JP 0212429 U 1/1990
JP 2006170495 A * 6/2006
JP 3145473 U 10/2008

* cited by examiner

ENHANCED FLUE GAS DAMPER MIXING DEVICE

BACKGROUND

The present disclosure discloses a device that efficiently mixes two flowing combustion gas streams and reduces gas backpressure under varying furnace loads.

It is common to mix gases of different temperatures in many applications, such as in boilers or steam generators. For example, all hot flue gases are passed through an economizer when the furnace of a boiler is operating at full load. The economizer recovers heat from the flue gases to preheat feed water that is circulated back into the boiler. The resulting flue gases exiting are cooler, due to the heat transfer. Therefore, the heat is recycled into the boiler, increasing boiler efficiency.

However, when the furnace/boiler is operating at a low load, if all of the flue gases are passed through the economizer, the temperature of the flue gases may drop below a critical temperature required for certain chemical processes, such as the catalytic removal of NO, $NO_2$ (collectively referred to as $NO_x$) from the flue gases in a selective catalytic reduction ("SCR") system. Since the catalytic reactions are temperature dependent, the SCR must function within a specified temperature range in order to satisfactorily perform its required function.

Therefore, in low boiler load conditions, only a portion of the flue gases should pass through the economizer, and the remainder should bypass the economizer to maintain a higher temperature. These two gas streams are then mixed to result in flue gases within a required temperature range.

One way to regulate flue gas temperature is through the use of dampers and bypasses. A flue gas bypass allows a portion of the flue gas stream to bypass the economizer, with the remaining portion of flue gas stream being routed through the economizer. The streams are then mixed to result in a mixed stream that has a higher temperature than if all of the flue gases passed through the economizer.

Conventional boilers employ mixers with angled, fixed vanes. These mix the gas, but produce a pressure drop at all boiler loads. This pressure drop requires larger, more expensive fans and increased auxiliary power consumption.

Conventional mixers require a certain time period to mix the gases, under a given boiler load. This equates to a certain duct length (transition section) to sufficiently mix the flowing gas streams. There may be an excess of high temperature gases in contact with the surface of the flue duct causing 'hot spots'. The 'hot spots require high temperature metals, which are typically more expensive than standard metal. Longer transition sections add to the costs of the system. It would be beneficial to employ a device that would mix two flue gas streams more quickly, and after a shorter length down the flue gas duct. This would then shorten the transition section, thereby requiring less high temperature metal to construct the device.

Currently, there is a need for a simple and inexpensive device for mixing gases more efficiently that reduces the backpressure under various boiler loads.

The disclosure may be understood more readily by reference to the following detailed description of the various features of the disclosure and the examples included therein.

SUMMARY OF THE INVENTION

The present invention may be described as a damper mixing device for mixing two gas streams in a flue gas duct comprising:

a set of first rows having a plurality of adjustable louvers each having louver vanes pivotable on a pivot, such that they may be positioned in a first direction, causing flue gas passing through them to be mixed; or to be vertically positioned when only one gas stream is being received;

a second set of rows interleaved with the first set of rows, the second set of rows having a plurality of adjustable louvers each having louver vanes pivotable on a pivot, such that they may be angled in a direction different from the first direction, causing the gas streams to be mixed, or to be positioned vertically when effectively only a single gas stream is being received; and a control unit connected to the louvers, adapted to position the louver vanes in the proper angled positions when at least two gas streams are being received, and for positioning the louver vanes vertically when effectively only a single gas stream is being received.

The present invention may also be embodied as a flue gas duct system having a backpass for receiving flue gases from a furnace that operates under various loads, comprising:

at least one heat exchanger within the backpass functioning to extract heat from the flue gases;

a lower flue section being a flue gas conduit coupled to the outlet of the backpass for adapted to receive the flue gases;

an upper flue section being a flue gas conduit connected to downstream flue gas processing devices;

a middle flue section being a flue gas conduit for conveying the flue gases from the lower flue section to the upper flue section;

a bypass being a flue gas conduit located in the backpass, upstream of the economizers, and connecting to the middle flue section;

an inlet control damper within the lower duct, adapted to adjust the amount of flue gases that flow from the lower flue section to the middle flue section;

a bypass control damper within the bypass duct, adapted to control the amount of flue gases passing from the backpass to the middle duct, bypassing the economizers; and a damper mixing device for mixing two gas streams in a flue gas duct comprising:

a set of first rows having a plurality of louvers each having adjustable louver vanes pivotable on a pivot, such that they may angled in a first direction when at least two gas streams are being received, causing flue gases passing through them to be mixed; or to be vertically positioned when effectively only one gas stream is being received;

a second set of rows interleaved with the first set of rows, the second set of rows with each having louvers with adjustable louver vanes pivotable on a pivot, such that they may be angled in a direction different form the first direction causing gas streams passing through them to directed in a to be mixed, or to be positioned vertically when only one gas stream is being received.

a control unit connected to the louvers, adapted to position the louver vanes in the proper angled positions when at least two gas streams are being received, and for positioning the louver vanes vertically when effectively only a single gas stream is being received.

BRIEF DESCRIPTION OF THE DRAWINGS

Referring now to the figures wherein the like elements are numbered alike.

DETAILED DESCRIPTION

When the boiler is operating near full capacity, there is little or no gas flow through the bypass, there is effectively only a single gas stream and no need for mixing. As the boiler load decreases, increasing amount of flue gas must bypass the economizer to maintain the correct flue gas temperature, thereby creating two different gas streams. There is only need for gas mixing when there are at least two gas streams to be mixed. The prior art designs make no distinction between different boiler loads and are not adjustable. Therefore, they have a non-adjustable mixer that creates pressure drops under all boiler loads, with the highest pressure drop at the highest boiler load, where mixing is not needed.

The present invention provides minimal pressure drop when there is effectively only a single gas stream flowing. It also is adjustable to optimize mixing and minimize backpressure across the full operating range of the steam generator.

It employs a simple, lower cost louver damper design to operate as a gas mixer that will reduce system capital costs. This will eliminate the need for a separate mixer, and minimize gas backpressure and associated operating power costs.

Figure 1:
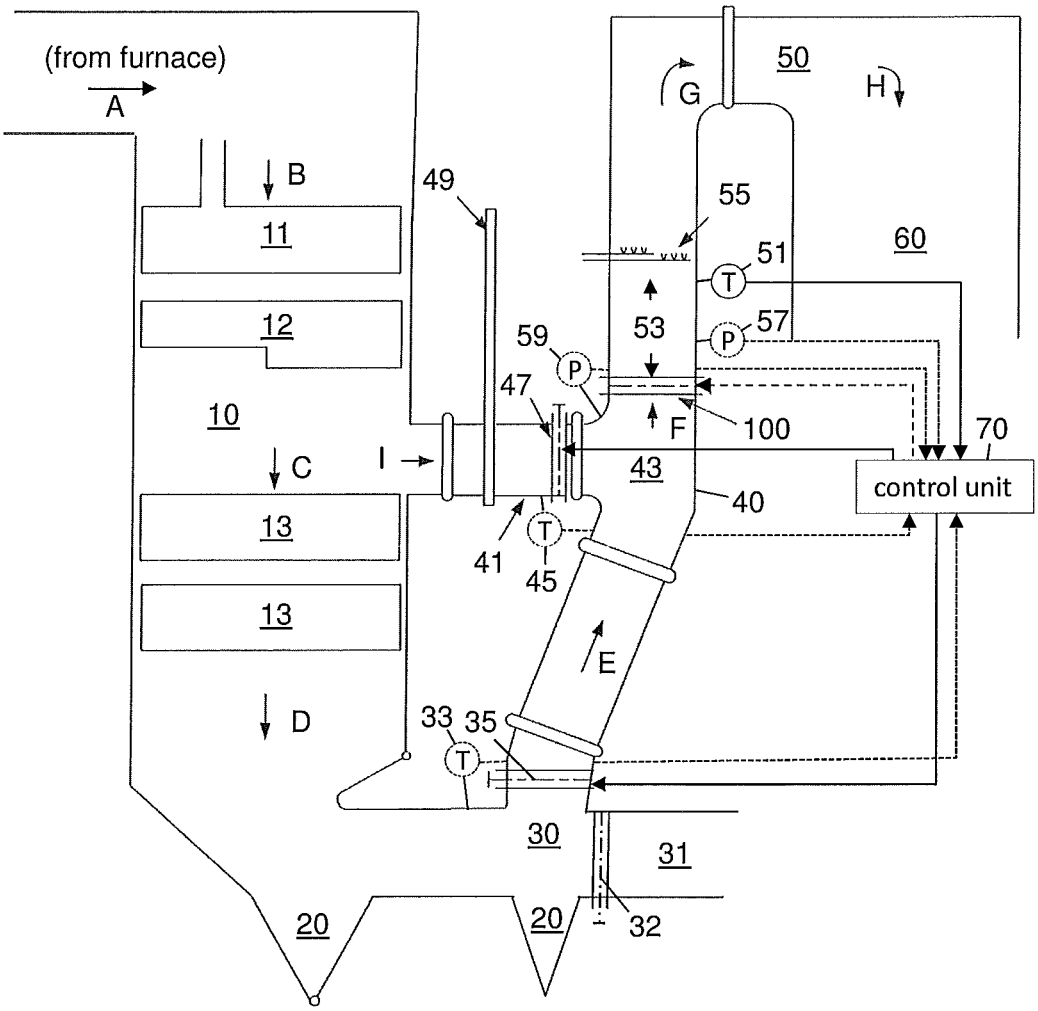
FIG. 1 is a side elevational diagram of an economizer bypass arrangement employing the present invention.

FIG. 1 is a side elevational diagram of an economizer bypass arrangement employing the present invention.

Gases from combustion in a furnace indicated by arrow "A", enter a backpass 10 from the top of FIG. 1 and move downward past superheaters 11 and reheaters 12 as shown by arrow "B". Heat from the hot flue gases is used to superheat steam in the superheaters 11 and reheat steam in the reheaters 12.

Under high boiler load conditions, most flue gases pass downward through the economizers as indicated by arrow "C". The flue gases transfer heat to feed water passing through tubes in the economizer 13, raising their temperature.

Ash in the flue gases continue downward as indicated by arrow "D". Ash is collected at the bottom of the backpass 10 and the lower flue section 30 in ash hoppers 20.

The flue gas continues through ductwork in a lower flue section 30 and upward as indicated by arrows "E" and "F" through a middle flue section 40 and an upper flue section 50, as indicated by arrow "G" to a selective catalytic reactor ("SCR") 70 as indicated by arrow H".

When the boiler is operating under lower loads, flue gases are passed through a bypass duct 41 as indicated by arrow "I" and though a T-section 43 into the middle flue section 40, mixing with the gases from the lower flue section 30.

When the SCR is not operating the inlet control damper 35 is closed and the flue duct stream enters an SCR bypass duct 31 bypassing the SCR 60. Optionally there may be an SCR bypass damper 32 that operates to open or close the SCR bypass duct 31.

The flow of flue gas through the bypass duct 41 is controlled by a bypass control damper 47. Similarly, the flow of flue gas through the lower flue section 30 is controlled by an inlet control damper 35.

A temperature sensor 51 at the upper flue section, downstream from the T-section 43, provides the flue gas temperature to a control unit 70. Based upon the sensed temperature, control unit 70 operates inlet control damper 35 and bypass control damper 47 to provide the proper mix to attain a desired mixed flue gas temperature at temperature sensor 51.

A mixing device is located downstream of the T-section 43. The present invention employs a damper mixing device 100 to more efficiently mix the flue gases from the economizer bypass duct 41 and the lower flue section 30.

Figure 2:
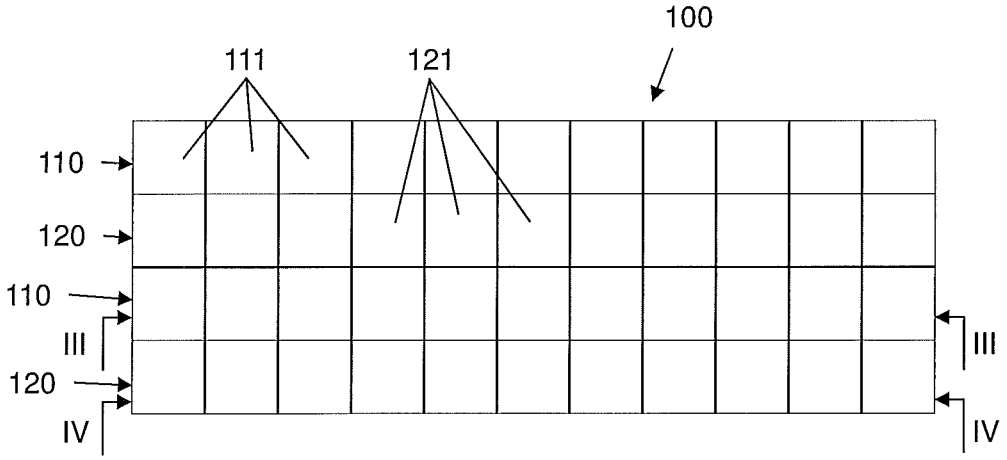
FIG. 2 is a plan view from above of one embodiment of a flue gas mixing device according to the present invention.

The damper mixing device 100, shown in FIG. 2 is a louvered mixing device that efficiently mixes the two gas streams.

FIG. 2 is a plan view of one embodiment of a damper mixing device 100 according to the present invention. The invention will be described with reference to both FIGS. 1 and 2. FIG. 2 shows a cross section through the upper flue section 50 looking downward on the damper mixing device 100. There is a plurality of louvers 111, 121 in rows 110, 120 of the damper mixing device 100. In this embodiment, the louvers 111 of rows 110 operate together. Also, louvers 121 of rows 120 also operate together, but separately from rows 110.

Figure 3:
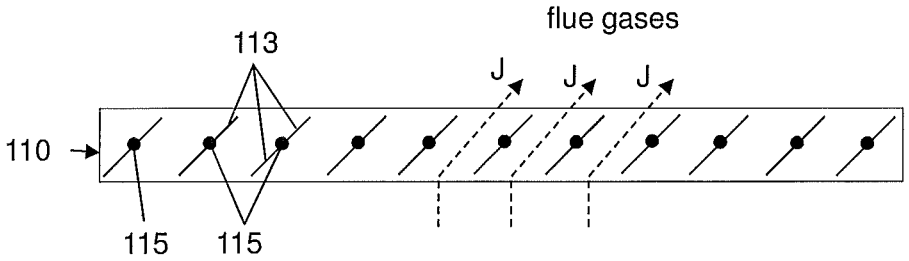
FIG. 3 is a side elevational view of a cross section of the gas mixing device viewed along lines "III-III" of FIG. 2.

FIG. 3 is a side elevational view of a cross section of the damper mixing device 100 viewed along lines "III-III" of FIG. 2. Here, louvers 111 of row 110 are shown operating together. Each louver 111 has louver vanes 113 that pivot on pivots 115. Here they are pivoted to angle from bottom left to upper right. Flue gas passing upward through the louvers 111 are directed in the direction of arrows "J".

Figure 4:
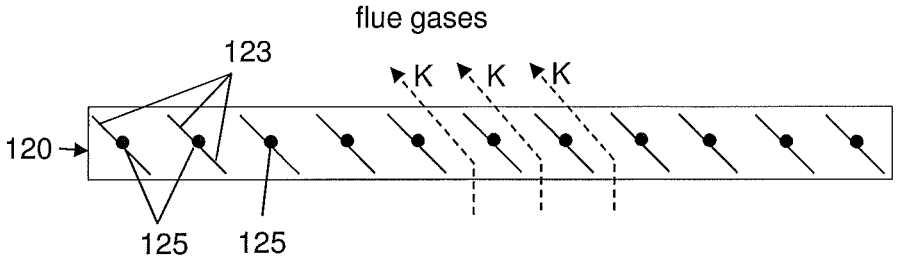
FIG. 4 is a side elevational view of a cross section of the gas mixing device viewed along lines "IV-IV" of FIG. 2.

FIG. 4 is a side elevational view of a cross section of the gas mixing device viewed along lines "IV-IV" of FIG. 2. Here, louvers 121 of row 120 are shown operating together. Each louver 121 has louver vanes 123 that pivot on pivots 125. Here they are pivoted to angle from bottom right to upper left. Flue gas passing upward through the louvers 121 are directed in the direction of arrows "K".

In an alternative embodiment, a temperature sensor 33 senses the flue gas temperature just upstream of the inlet control damper 35, and a temperature sensor 45 senses the flue gas temperature just upstream of the bypass control damper 47. Control unit 70 takes these into consideration when calculating how to control the inlet control damper 35 and the bypass control damper 47.

The interleaved rows 110, 120 cause turbulence in the flue gases mixing them. Control unit 70 operates the pivoting of the louvers 111, 121. Control unit 70 also has information on the temperatures of the flue gas the in the upper flue section 50 (and optionally, near the inlet control damper 35 and the bypass control damper 47). Control unit 70 also has information on the opening of bypass control damper 47 and inlet control damper 35. Therefore, control unit can use this information to calculate the angle positions for the louvers 111 and 121.

If for example, bypass control damper 47 is closed, then there is only a single stream of flue gas from the lower flue section 30. All louvers 111, 121 are then set to a vertical position, parallel with the gas stream flow at this location, minimizing the pressure drop across the damper mixing device 100. Similarly, if all of the flue gas is passing through the bypass duct 41, then again, the louvers 111, 121 are again set to a vertical position, again the minimizing pressure drop. The control unit 70 also adjusts the opening of the louvers 111, 121 based upon the relative openings of the bypass control damper 47, the inlet control damper 35, and the sensed temperatures to maximize mixing, while minimizing backpressure.

The damper mixing device 100 can be modulated to effectively enhance the thermal mixing of two gas streams in a shorter distance than conventional static mixers. This is accomplished by regulating the angle of each row 110, 120 of louvers to create turbulent mixing as required.

In another embodiment of the present invention, temperature sensor 51 employs a plurality of temperature sensors which measure temperature across the upper flue section 50. It also has gas pressure sensors just upstream and downstream of the damper mixing device 100 to measure pressure drop across the damper mixing device.

Therefore, control unit 70 can iterative try various angle settings of the louvers 111, 121 and measure the temperature across the upper flue section 50 and associate pressure drop across the damper mixing device. Therefore, there will be combinations of louver settings that will optimize the combination of pressure drop and temperature homogeneity.

Another use of the damper mixing device 100 would be to improve flow distribution downstream into an ammonia injection grid 55, used for uniform injection of ammonia that reacts with $NO_x$ in the presence of the catalyst in the SCR 60 to reduce the NO to nitrogen and water vapor.

In another alternative embodiment, the present invention can be used in oxy-combustion. Oxy-combustion is the process of burning fuel in a substantially nitrogen-free environment to produce a flue gas that is substantially $CO_2$ and water vapor. Wherein the $CO_2$ may be separated from the water vapor and the $CO_2$ sequestered and stored.

The present invention can be used to mix oxygen streams into recirculated flue gas stream to provide a uniform distribution of oxygen into the mixed streams.

The present invention overcomes the problems noted in the prior art. Therefore, the simple louver design is expected to be a cost saving above the prior art gas mixer designs. The adjustable louver design minimizes pressure drop for high boiler loads. This reduces the need for larger and more expensive fans and blower equipment.

The flue gases mix faster and in a shorter transition area downstream from the damper mixing device 100. This requires less high temperature material and is less costly to construct.

An additional advantage is that the damper mixing device 100 can close all louvers 111, 121 to provide additional flue gas shutoff capability when system is not in operation, such as shutting off flue gases to an SCR when it is not in operation.

Unless otherwise specified, all ranges disclosed herein are inclusive and combinable at the end points and all intermediate points therein. The terms "first," "second," and the like, herein do not denote any order, quantity, or importance, but rather are used to distinguish one element from another. The terms "a" and "an" herein do not denote a limitation of quantity, but rather denote the presence of at least one of the referenced item. All numerals modified by "about" are inclusive of the precise numeric value unless otherwise specified.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A flue gas duct system having a backpass for receiving flue gases from a furnace that operates under various loads, comprising:

at least one heat exchanger disposed within the backpass adapted to extract heat from the flue gases;

a lower flue section being a flue gas conduit coupled to the outlet of the backpass adapted to receive the flue gases;

an upper flue section being a flue gas conduit coupled to downstream flue gas processing devices;

a middle flue section being a flue gas conduit adapted to convey the flue gases from the lower flue section to the upper flue section;

a bypass coupled to the backpass at the middle flue section upstream of an economizer, where the bypass is a flue gas conduit;

an inlet control damper disposed within the lower duct, adapted to adjust the amount of flue gases that flow from the lower flue section to the middle flue section;

a bypass control damper disposed within the bypass duct, adapted to control the amount of flue gases passing from the backpass to the middle duct, thereby bypassing the economizer; and a damper mixing device for mixing two gas streams in an elongate flue as duct comprising:

a plurality of first rows of louvers, each first row of louvers having a plurality of louvers having adjustable louver vanes pivotable on a pivot about a respective axis, the adjustable louver vanes being positioned in a first direction when at least two gas streams are being received, causing the flue gases passing through the adjustable louver vanes of the plurality of first rows of louvers to be mixed, and positioned in a second direction aligned with the direction of the flue gas when effectively only one gas stream is being received;

wherein each respective row of the plurality of first rows of louvers is spaced from the remaining rows of the plurality of first rows in the longitudinal direction of the flue gas duct;

a plurality of second rows of louvers interleaved, with the plurality of first rows of louvers, each second row of louvers having a plurality of louvers with adjustable louver vanes pivotable on a pivot about a respective axis, the adjustable louver vanes may be positioned in a direction different from the first direction when at least two gas streams are being received causing the flue gases passing through the adjustable louver vanes of the plurality of second rows of louvers to be mixed, and positioned in the second direction aligned with the direction of the flue gas when effectively only one gas stream is being received; wherein each respective row of the plurality of second row of louvers is spaced from the remaining rows of the plurality of second rows of louvers in the longitudinal direction of the flue gas duct; and a control unit connected to the louvers, adapted to position the louver vanes of the first rows of louvers in the first direction, and the louver vanes of the second rows of louvers in the direction different from the first direction when at least two gas streams are being received, and for positioning the louver vanes of the plurality of first and second rows of louvers in the second direction aligned with the direction of the flue gas when effectively only a single gas stream is being received.

2. The device of claim 1, wherein the control unit is adapted to position all of the louvers of a given row of the plurality of first rows of louvers at the same angle when at least two oases streams are being received.

3. The device of claim 1, wherein the control unit is adapted to position all louvers in a given row of the plurality of first rows of louvers in a same direction that is opposite the angle of all louvers of adjacent rows of the plurality of second rows of louvers, when at least two gas streams are being received.

4. The device of claim 1, further comprising:

a top temperature sensor disposed in the upper flue section in communication with the control unit and adapted to measure a temperature in the upper flue section and to provide an indication of the measured temperature to the control unit to determine an amount to open inlet control damper and bypass control damper.

5. The device of claim 4, further comprising:

a bottom temperature sensor disposed upstream of the inlet control damper, in communication with the control unit, and adapted to measure a temperature of the flue gases in the lower flue section.

6. The device of claim 5, further comprising:

a bypass temperature sensor disposed upstream of the bypass control damper, in communication with the control unit, and adapted to measure a temperature of the flue gases in the bypass duct and to provide an indication of the measured temperature to the controller.

7. The device of claim 1, further comprising:

a first pressure sensor upstream of the damper control mixing device, and a second pressure sensor downstream of the damper control mixing device, the pressure sensors adapted to measure pressure drop across the damper control mixing device and to provide the pressure drop measurement to control unit.

8. The device of claim 1 wherein:

the control unit is further adapted to interactively change the louver positions under varying boiler loads to determine louver angles that optimize both the pressure drop and maximize mixing effectiveness.

9. The device of claim 1 wherein:

the louvers within a row of the plurality of first rows of louver may be adjusted to different positions.

10. The device of claim 1, wherein each respective axis of the pivot of the vanes of the plurality of first rows of louvers is different, and each respective axis of the pivot of the vanes of a respective second row of the plurality of second rows of louvers is different.

* * * * *